US006688314B1

(12) United States Patent
Hoeffkes et al.

(10) Patent No.: US 6,688,314 B1
(45) Date of Patent: Feb. 10, 2004

(54) APPLICATION DEVICE FOR HIGHLIGHTING HAIR

(75) Inventors: Horst Hoeffkes, Duesseldorf (DE); Hans Schneider, Wegberg (DE); Detlef Hollenberg, Erkrath (DE); Peter Solich, Cologne (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/980,477

(22) PCT Filed: May 6, 2000

(86) PCT No.: PCT/EP00/04088

§ 371 (c)(1),
(2), (4) Date: Mar. 25, 2002

(87) PCT Pub. No.: WO00/69308

PCT Pub. Date: Nov. 23, 2000

(30) Foreign Application Priority Data

May 17, 1999 (DE) ..... 199 22 092

(51) Int. Cl.[7] ..... A45D 19/02; A46B 11/00
(52) U.S. Cl. ..... 132/114; 132/116
(58) Field of Search ..... 132/109, 110, 132/111, 112, 113, 114, 115, 116; 401/266, 14; 222/567, 568, 570

(56) References Cited

U.S. PATENT DOCUMENTS

| | | | | | |
|---|---|---|---|---|---|
| 1,382,586 | A | * | 6/1921 | Wilson | 132/110 |
| 2,672,875 | A | | 3/1954 | Kovacs | 132/13 |
| 2,758,606 | A | * | 8/1956 | Usai | 132/110 |
| 2,922,425 | A | * | 1/1960 | Lerner et al. | 132/212 |
| 2,982,987 | A | * | 5/1961 | Knapp | 401/139 |
| 4,881,558 | A | | 11/1989 | Hollenberg et al. | 132/112 |
| 5,067,501 | A | * | 11/1991 | Auger | 132/116 |
| 5,483,979 | A | * | 1/1996 | Bertieri | 132/114 |
| 5,755,241 | A | * | 5/1998 | Cheung | 132/112 |
| 5,984,557 | A | * | 11/1999 | Fennell | 401/193 |
| 6,009,881 | A | | 1/2000 | Baudin et al. | 132/112 |

FOREIGN PATENT DOCUMENTS

| | | |
|---|---|---|
| EP | 0 910 967 | 4/1999 |
| GB | 879 577 | 10/1961 |
| GB | 2243996 | * 11/1991 |
| GB | 2 256 586 | 12/1992 |

* cited by examiner

*Primary Examiner*—Todd E. Manahan
(74) *Attorney, Agent, or Firm*—Stephen D. Harper; Gregory M. Hill

(57) ABSTRACT

The present invention relates to an applicator device for highlighting hair. The applicator device includes a closure cap for mounting on a container, at least one product guide located on the closure cap for dispensing hair colorant, and at least guide prong located adjacent to the product guide. The guide prong is removable from the applicator device and is substantially in the shape of a strip with a width that extends beyond the product guide in at least one direction.

26 Claims, 5 Drawing Sheets

Fig. 9
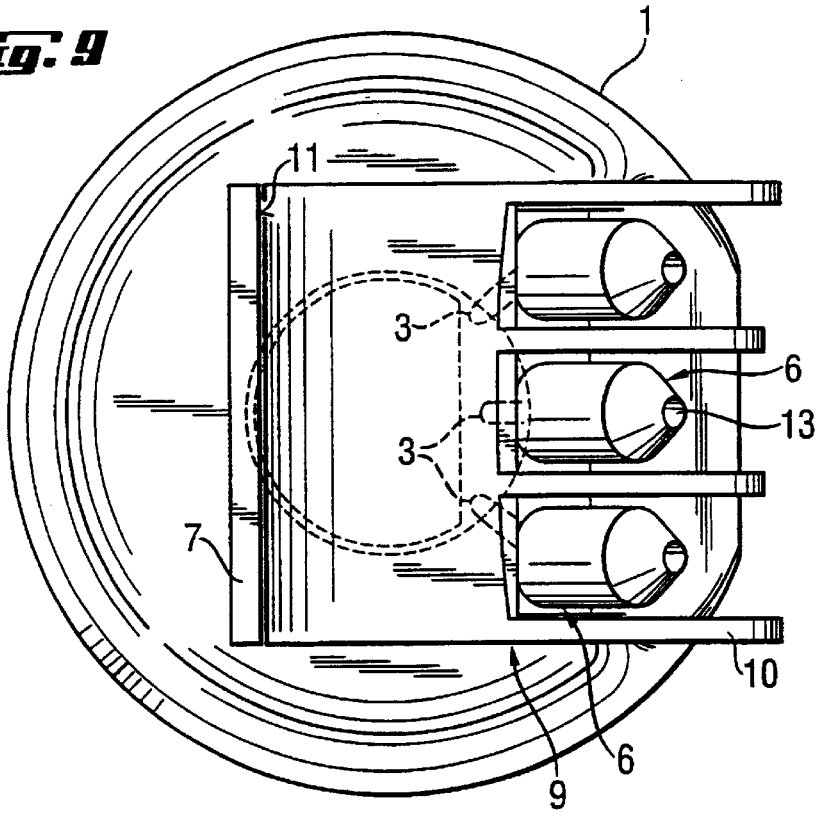
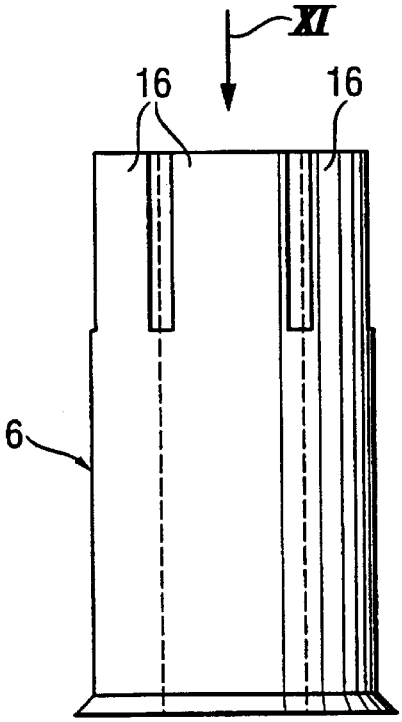
Fig. 10
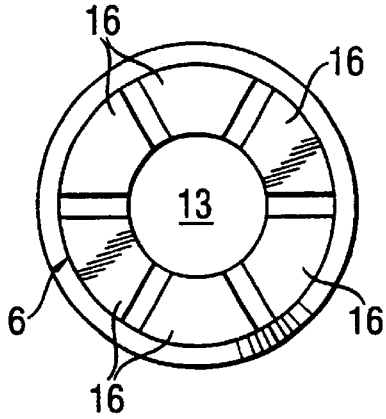
Fig. 11

APPLICATION DEVICE FOR HIGHLIGHTING HAIR

CROSS REFERENCE TO RELATED APPLICATIONS

This application is a national stage application under 35 U.S.C. §371 of international application PCT/EP00/04088 filed on May 6, 2000, the international application not being published in English. This application also claims priority under 35 U.S.C. §119 to DE 199 22 092.1, filed on May 17, 1999.

FIELD OF THE INVENTION

The invention relates to an application device for highlighting hair, which is constructed particularly in the form of closure cap for mounting on the opening of a container receiving or containing a hair colorant, wherein the cap has at least one outlet opening, with at least one product guide and adjacent thereto at least one removable guide prong.

BACKGROUND OF THE INVENTION

An application device of this kind is known from United States Patent Specification U.S. Pat. No. 2,672,875. A plate with bores can be pushed into the device, the bores being aligned with the product guides in the cap in the pushed-in state of the plate. Outwardly extending bunches of bristles are arranged on the plate and between the product guides or bores. Dovetail-shape grooves, in each of which the base of a respective comb can be inserted, are arranged at both sides of the elongate, dovetail-shape grooved push-in opening for the said plate. The comb prongs, which correspond with the above-mentioned guide prongs, have the form of pins as usual with known combs.

A measured and uniform application of hair colouring agent to the hair is achieved by the arrangement of the bristles around the outlet opening, because the bristles on the one hand prevent issue of too great a quantity of the agent and on the other hand distribute the agent uniformly by the brushing motion.

In the case of the known application device for colouring strands of hair the bristles are covered in their entire length with the hair colorant, although only the bristle ends have to be used for dyeing locks of hair. This has the consequence that in the case of a comb movement, parts of the hair lying to the side of the hair locks to be coloured are also covered by the colouring agent, which is not, however, desired in dyeing the strands. The use of comb prongs corresponding to U.S. Pat. No. 2,672,875 does not make any difference, because the hair colouring agent flows outwardly at both sides around the pin-shaped comb prongs so that the coloured strip-shaped region is widened. Moreover, in the case of certain hair colouring agents the agent, which is forced out of the outlet opening by manual pressure on the flexible wall, is obstructed by the bristles such that a sufficient feed of the agent to the bristle ends is not always guaranteed.

In the case of known application devices the user is therefore limited to only one kind of dye. The user can dye his or her hair over a wide area or in narrow strips with intermediately disposed undyed hair locks.

The invention therefore has the object, in relation to an application device of the kind stated in the introduction, of improving the use property thereof for the colouring of hair locks. In particular, it should be made possible for the user to achieve, with the same application device, not only a wide-area dyeing, but also dyeing of a particularly narrow hair lock which is cleanly separated from undyed locks.

SUMMARY OF THE INVENTION

According to the invention this object is met in the case of the application device of the kind stated in the introduction in the manner that the guide prong is formed to be substantially strip-shaped and the width thereof is at least twice as large as the inner diameter of the product guide.

When the guide prong is removed, the hair colorant is distributed over a wide area on the hair locks, so that a wide dyed strip is achieved. If, however, the guide prong is fitted, the user obtains a narrow dyed hair lock, wherein the shape and width of the guide prong prevents the hair colorant from running outwardly at the sides of the lock to be dyed and thus widening the dyed lock in undesired manner and usually also non-uniformly, in that instance depending on the manual pressure on the hair. An advantageous secondary effect of the guide prong is the combing, and thus hair disentangling, action thereof.

In order to be able to produce a lock which is narrowly and cleanly separated at both edges from undyed hair it is moreover of advantage if at least two guide prongs are provided, between which the at least one product guide is arranged.

If several dyed locks are to be made possible simultaneously and—when the guide prongs are removed—a particularly wide dyed lock, then it is of advantage if several product guides arranged adjacent to one another are provided, between which the removable guide prongs are arranged. When the guide prongs are fitted, dyed locks which are arranged parallel to and cleanly separated from one another by an undyed region are obtained. The guide prongs here additionally serve the purpose of preventing the narrow dyed strip-shaped hair regions from running into one another. The hairs present between the strips remain completely undyed, due to the combing action of the guide prongs. The principal cause for this effect resides in the fact that the guide prongs narrow the outlet region of the hair colorant from the application device to tightly limited regions clearly separated from one another. This narrowing and limiting of the outlet regions of the hair colorant is achieved with the above-mentioned application device even with only one product guide and only one guide prong.

So that the outer ones of the dyed hair locks arranged parallel to one another are cleanly delimited at their outer edges relative to the rest of the hair and the outer hair locks have the same width as the inner hair locks it is additionally of advantage if each product guide is arranged between two mutually opposite guide prongs.

Moreover, it is proposed that the product guides are resilient. In use of the application device the product guides are lightly bent against the direction of movement so that the application of the colorant is made easier.

The product guides can be formed as tubelets, for example as a flexible hose and particularly as a silicon hose. In that case it is preferred if the tubelets are formed to be bristle-like at the outlet opening, as explained in more detail in the following by way of an example of embodiment. The bristles on the one hand exert an additional combing action and on the other hand distribute the hair colorant particularly uniformly on the hair locks.

Moreover it is proposed that bristles are arranged around the outlet openings of the product guides. A more measured and uniform application of the hair colouring agent to the hair is thereby achieved. The bristles on the one hand prevent issue of too great a quantity of the agent and on the other hand distribute the agent uniformly by the brushing motion.

In that case it is particularly preferred if the outlet openings of the product guides are arranged at a spacing from the bristle base. In this manner the outlet opening is displaced to a certain extent from the bristle base into the central region of the bristles, so that the agent is passed substantially only to the bristle ends and the throttling action of the bristles on the agent is partly relieved. Moreover it is thereby avoided that appreciable quantities of hair colouring agent remain at the bristle base, thus in the foot region of the bristles, and do not get to the hair, but dry out in this region. Overall, the dyeing of hair locks is improved by the application device.

Nevertheless, the agent should pass to the hair not directly, but only by way of the bristle ends. It is therefore proposed that the outlet openings are arranged between the bristle base and the bristle ends.

In an advantageous embodiment of the invention it is proposed that the cap has a bore which is outwardly prolonged by means of a tubelet towards the outlet opening, the length of the tubelet being smaller than the bristle length, wherein the tubelet extends outwardly from the bristle base substantially parallel to the bristles.

It has proved particularly advantageous in the sense of the invention if the length of the tubelet corresponds to approximately two-thirds of the bristle length. If the bristles are arranged in the manner of a ring around the outlet opening, it is ensured with certainty that the hair colouring agent always goes firstly to the bristles and not directly to the hair strands, so that the agent is uniformly applied without problems.

For simultaneous colouring of several hair strands it is of advantage if several outlet openings, preferably each formed as an opening of a respective tubelet, each with a respective bunch of bristles arranged around the respective outlet opening are disposed adjacent to one another. In this manner several hair strands lying parallel to one another and dyed in particularly uniform manner are produced.

In addition, there is proposed at least one guide prong which extends outwardly further than the product guides and, in particular, further than the bristles. Through the length of the guide prongs it is ensured that a minimum spacing of the bristle ends from the scalp is maintained so that only the hair locks lying at the top of the head hair, but not the hair region at the root or even the scalp, are treated with the hair colouring agent. Moreover, a particularly clean separation of the dyed region from the undyed region is achieved.

The hair strands are separated from one another particularly cleanly if in accordance with a further advantageous embodiment of the invention at least a part of the guide prongs is arranged between adjacent bunches of bristles.

If, as already proposed above, bunches of bristles are arranged around the outlet openings, it is of advantage if the width of the guide prongs is at least as large as the outer diameter of the bunch of bristles.

In that case it has proved particularly advantageous if the width of the guide prongs amounts to 2 to 7 mm and, particularly, 3 to 5 mm.

It is further proposed that the guide prongs are detachably fastened to the cap. For convenient manipulation it is additionally of advantage if the guide prongs are part of a one-piece attachment detachably connected with the cap. The prongs can then be removed from the cap together as a block in one operation and refitted as needed.

A simplification in recycling of the discarded application device is achieved if the cap and the bristles consist of different polyolefins and thus belong to the same class of synthetic material. In that case the cap should consist of a hard material and the bristles of a soft material. It is advantageous if the cap consists of polypropylene and the bristles consist of polyethylene, For economic production of the application device it is, in addition, proposed that the cap and the bristles are produced integrally in a multi-component injection-moulding process.

The invention moreover relates to a container, which contains hair colorant, with an application device as explained in the foregoing. In that case it is advantageous if the closure cap of the container is formed as such an application device.

Embodiments of the invention are described in more detail in the following by reference to drawings. There:

BRIEF DESCRIPTION OF THE DRAWINGS

FIG. 9 shows a second example of the application device according to the invention in a view, from above, with guide prongs fitted, FIG. 10 shows a side view of a product guide of an application device in accordance with a third embodiment according to the invention and FIG. 11 shows a view of the product guide according to FIG. 10 from above in the direction of the arrow XI.

The same reference numerals have the same significance in all drawings and, if appropriate, are therefore explained only once.

DETAILED DESCRIPTION OF THE INVENTION

Figure 1:
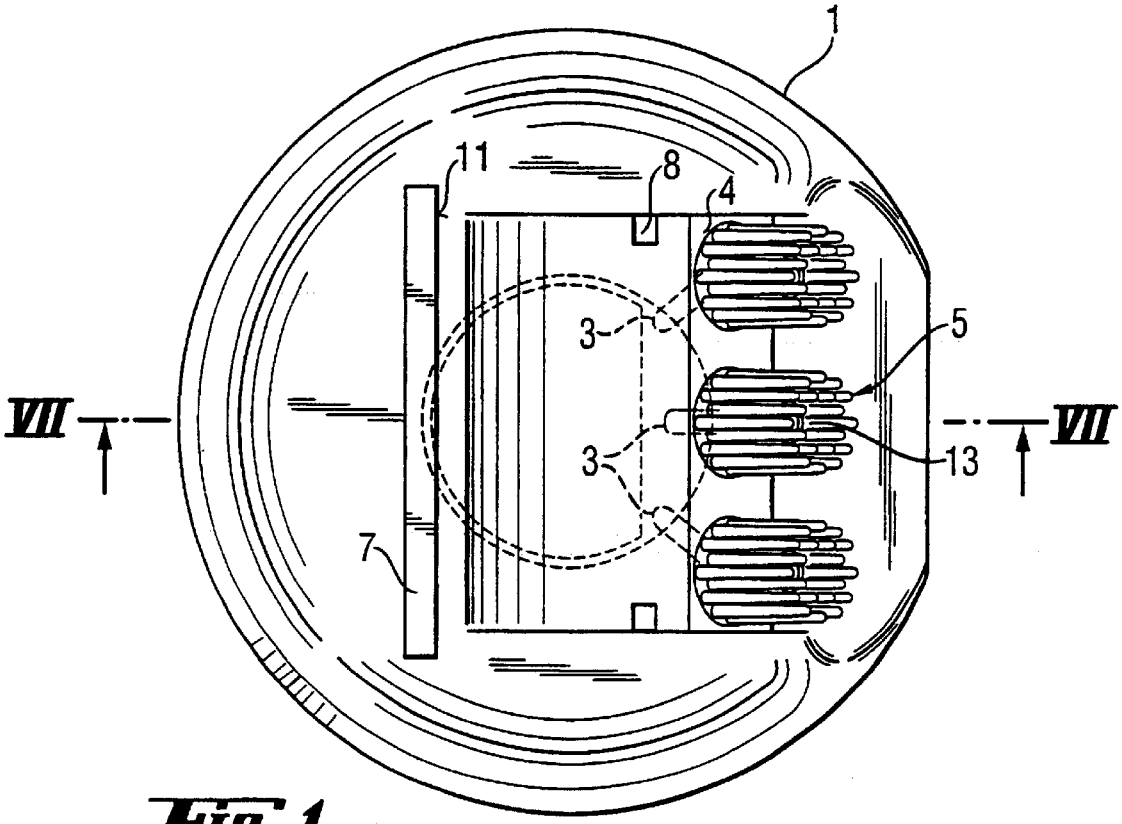
FIG. 1 shows an application device in accordance with a first embodiment according to the invention, in a view from above, without guide prongs.

The device consists of a cap 1 of a relatively hard polypropylene. A screw thread 2, by which the device can be screwed onto an external thread at the opening of a container (not illustrated) for a hair colouring agent, is provided in the interior of the pot-shaped cap within an inner pot-shaped element. Three bores 3 are formed at a cover wall region 4 lying obliquely relative to the longitudinal axis of the cap 1, around each of which bores there extends outwardly a respective ring-shaped bunch 5 of bristles. The bores 3 are disposed in flow path communication with the hair colouring agent, which is contained in the container, when the cap 1 is screwed onto the container. An outer surface of the cap 1 in that case forms the bristle base 14. The bunches 5 of bristles consist of a soft polyethylene.

Figure 8:
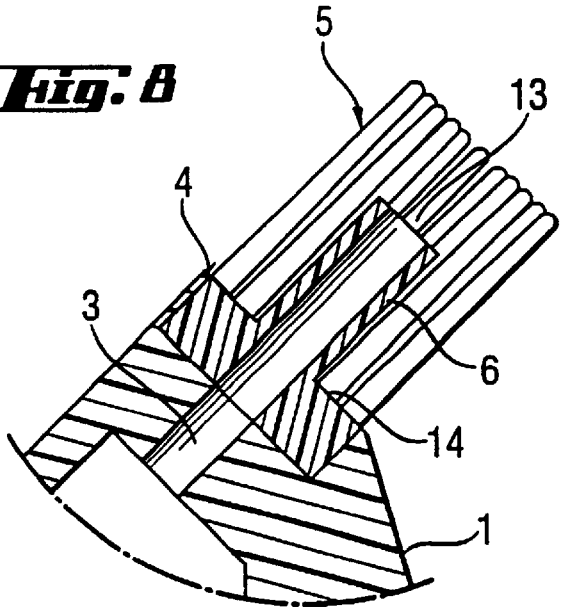
FIG. 8 shows the detail VIII in FIG. 7.

Each of the three bores 3 is prolonged upwardly by means of a respective tubelet 6 arranged parallel to the bristles 5 and placed on the respective bore 3, wherein the tubelet 6 extends over approximately two-thirds of the bristle length as measured from the bristle base 14 (outer surface of the cap 1) to the bristle ends (FIG. 8). The tubelets 6 each have an outlet opening 13.

A web 7 and grooves 8, by which a block 9 with guide prongs 10 can be retained on the cap 1 by clamping, are integrally moulded at the upper side of the cap 1. For this purpose the lower edge 11 bears against the web 7 and webs, which are not illustrated in the drawings, at the inner side of the block 9 engage in the grooves 8 of the cap 1.

Figure 6:
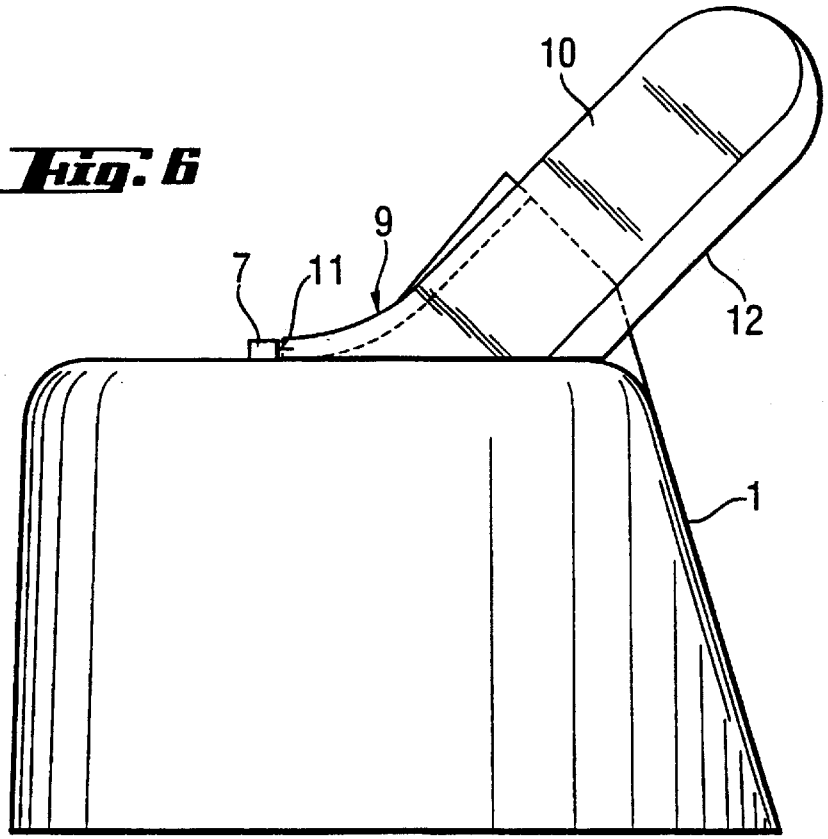
FIG. 6 shows the side view according to FIG. 5, but with guide prongs.
Figure 7:
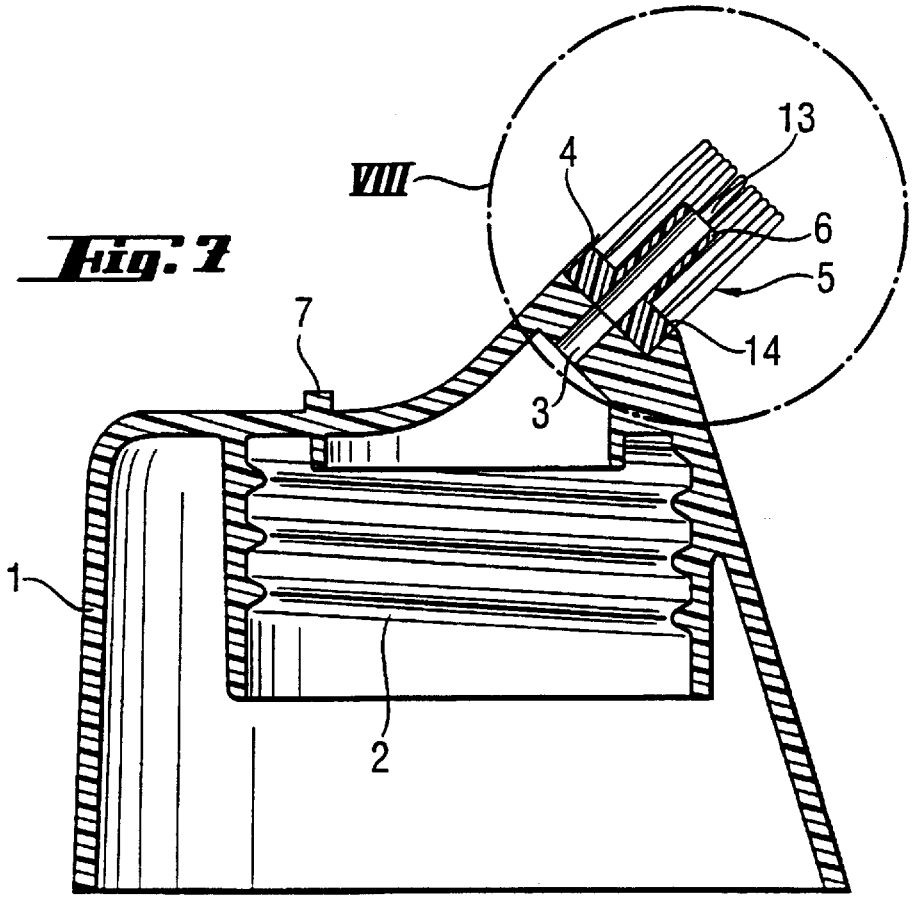
FIG. 7 shows a section along the line VII—VII in FIG. 3.

The block 9 has four guide prongs 10 which, when the block 9 is placed on the cap 1, are arranged between the bunches 5 of bristles and at the outer sides of the outermost bunches 5 of bristles and extend in the same oblique direction as the bristles 5. The forward edge 12 (FIG. 6) of each guide prong 10 is thickened and protrudes beyond the cap 1.

Figure 2:
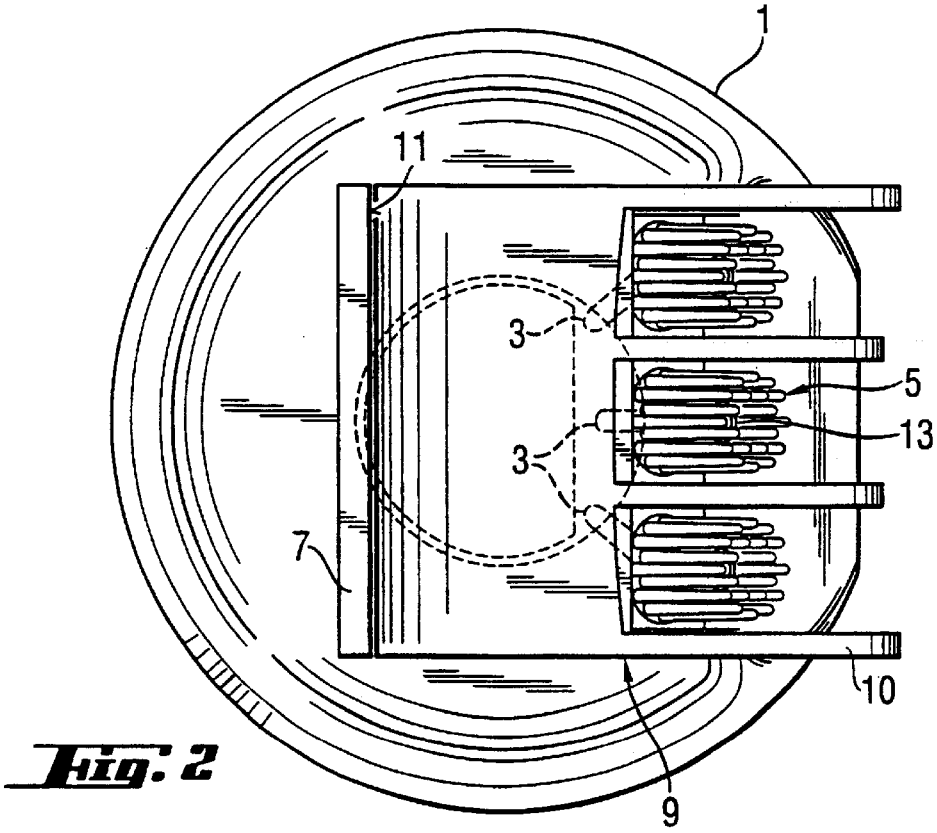
FIG. 2 shows the device according to FIG. 1 in a view from above with guide prongs fitted.
Figure 3:
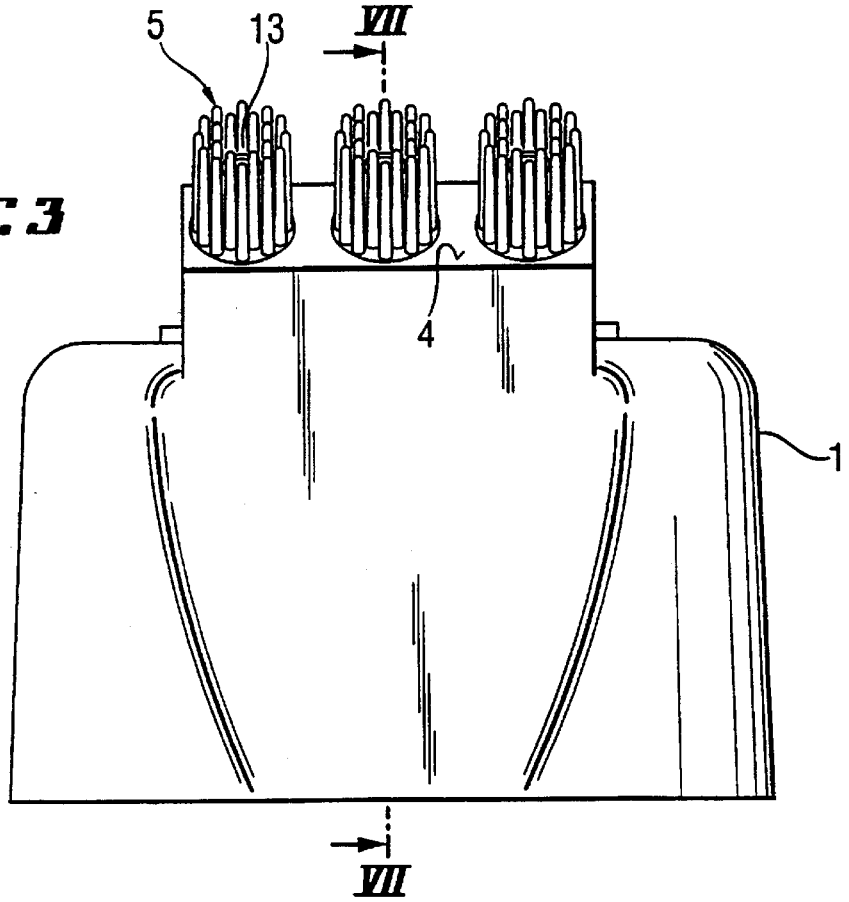
FIG. 3 shows a view of the device according to FIG. 1 from the front without guide prongs.
Figure 4:
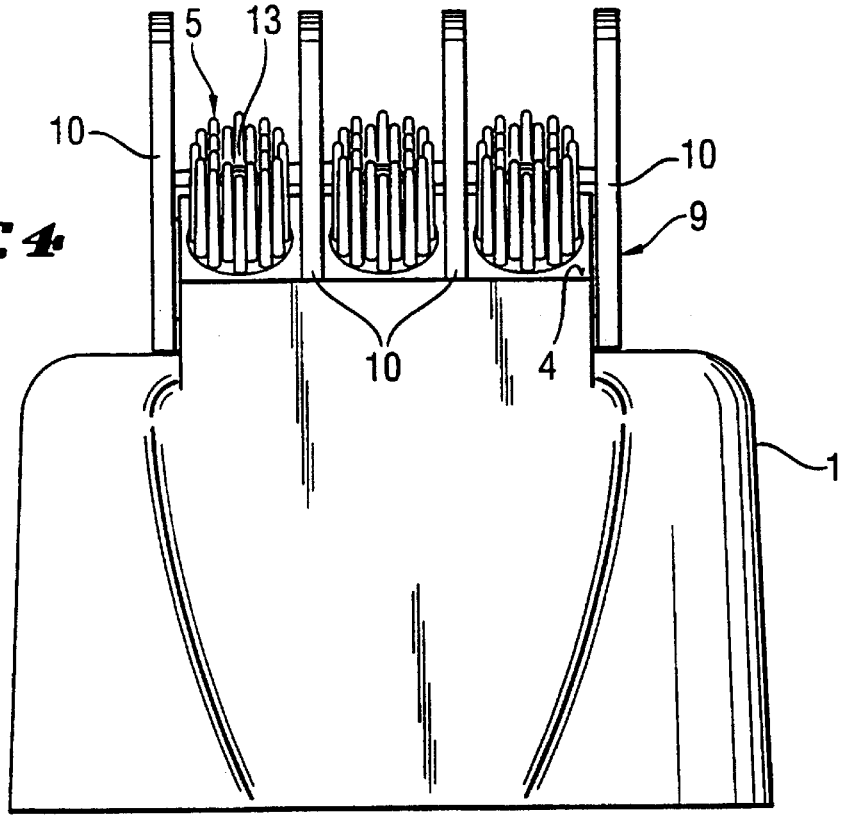
FIG. 4 shows a view of the device according to FIG. 1 from the front with guide prongs.
Figure 5:
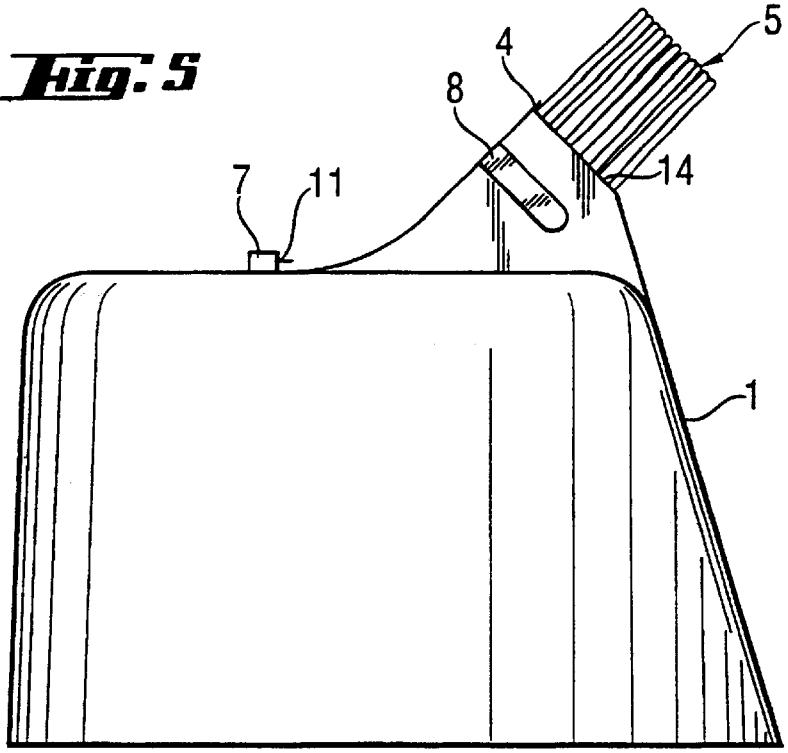
FIG. 5 shows a side view of the device according to FIG. 1 without guide prongs.

As clearly evident from FIGS. 2 and 4, the guide prongs 10 extend considerably beyond the bunches 5 of bristles so that in use the bunches 5 of bristles saturated with a hair colouring agent are kept away from the scalp of the user and only the outer side of the head hair is dyed in strip-shaped manner.

The second embodiment illustrated in FIG. 9 corresponds with the first embodiment, wherein, however, instead of the bristles 5 with inwardly disposed tubelets 6 there is provided only one flexible tubelet 6, which consists of silicon.

In a third embodiment in the case of the application device according to the invention there is similarly provided, instead of the bristles 5 with an inwardly disposed tubelet 6, a flexible tubelet 6 which in this case consists of transparent silicon, wherein the upper part is cut into so that bristle-like tongues 16 are formed there. This embodiment is particularly advantageous, since here the bristles and the tubelet are integrally constructed and can therefore be produced in particularly economic manner, wherein, however, the advantages of use of the additional bristles are maintained.

What is claimed is:

1. An applicator device for highlighting hair comprising (a) a closure cap for mounting on an opening of a container;

(b) at least one product guide, located on the closure cap and having at least one outlet opening for dispensing hair colorant; and (c) at least one guide prong located adjacent to the product guide wherein the guide prong is substantially in the shape of a strip, has a width that projects beyond the product guide in at least one direction, and is removable from the applicator device, wherein the at least one product guide is located between at least two opposing guide prongs.

2. The device of claim 1 wherein the device comprises two or more product guides that are arranged adjacent to one another.

3. The device of claim 2 wherein the product guides are resilient.

4. The device of claim 2 wherein the product guides are tubelets having a length.

5. The device of claim 4 wherein the tubelets are constructed to be bristle-like at the outlet opening.

6. The device of claim 4 further comprising bristles secured at a base and having a length and bristle ends, wherein the bristles are arranged around the outlet openings of the product guides.

7. The device of claim 6 wherein the outlet openings of the product guides are arranged at a spacing above the bristle base.

8. The device of claim 7 wherein the outlet openings of the product guides are located between the bristle base and the bristle ends.

9. The device of claim 6, wherein the closure cap has one or more bores which are prolonged outwardly by the tubelets, wherein the length of the tubelets are smaller than the length of the bristles, and wherein the tubelets extend outwardly from the base of the bristles and substantially parallel to the bristles.

10. The device of claim 9 wherein the length of the tubelets are approximately two-thirds of the length of the bristles.

11. The device of claim 9, wherein the bristles are arranged in a form of a ring around the outlet openings of the tubelets.

12. The device of claim 6 wherein the at least one guide prong extends outwardly further than the product guides and the bristles.

13. The device of claim 6 wherein the closure cap and the bristles are formed from different polyolefins.

14. The device of claim 13 wherein the closure cap comprises polypropylene and the bristles comprise polyethylene.

15. The device of claim 6 wherein the closure cap and the bristles are produced integrally in a multi-component injection-molding process.

16. The device of claim 1 wherein the device comprises two or more of the product guides and further comprises bristle bunches that surround each of the product guides, wherein the product guides are arranged adjacent to each other and are formed from tubelets having openings.

17. The device of claim 16 wherein at least a part of the guide prong is arranged between the bristle bunches.

18. The device of claim 16 wherein the bristle bunches are arranged in a form of a ring around each of the product guides.

19. The device of claim 18 wherein the width of the guide prong is at least as large as the outer diameter of the rings of bristle bunches.

20. The device of claim 1 wherein the width of the guide prong is 2 mm to 7 mm.

21. The device of claim 20 wherein the width of the guide prong is 3 mm to 5 mm.

22. The device of claim 1 wherein the guide prong is detachably fastened to the closure cap.

23. The device of claim 1 wherein the guide prong is part of a one-piece attachment detachably connected with the closure cap.

24. A container for coloring hair comprising an applicator device wherein the applicator device comprises (a) at least one product guide, located on the applicator device and having at least one outlet opening for dispensing hair colorant; and (b) at least one guide prong located adjacent to the product guide wherein the guide prong is substantially in the shape of a strip, has a width that projects beyond the product guide in at least one direction, and is removable from the applicator device, wherein the at least one product guide is located between at least two opposing guide prongs.

25. The container of claim 24 wherein the application device is a closure cap for the container.

26. The container of claim 24 wherein the container comprises hair colorant.

* * * * *